US005961374A

United States Patent [19]

Minami et al.

[11] Patent Number: 5,961,374

[45] Date of Patent: Oct. 5, 1999

[54] METHOD AND APPARATUS OF POLISHING END SURFACES OF ROD-SHAPED MEMBERS

[75] Inventors: Kouji Minami; Hiroyuki Tokita; Muneo Kawasaki; Nobuo Suzuki, all of Koto-ku, Japan

[73] Assignee: Seiko Instruments Inc., Japan

[21] Appl. No.: 08/905,112

[22] Filed: Aug. 1, 1997

[30] Foreign Application Priority Data

Aug. 2, 1996 [JP] Japan ..... 8-205035

[51] Int. Cl.[6] ..... B24B 1/00

[52] U.S. Cl. ..... 451/41; 451/391

[58] Field of Search ..... 451/390, 391, 451/384, 36, 41

[56] References Cited

U.S. PATENT DOCUMENTS

| | | | |
|---|---|---|---|
| 3,868,794 | 3/1975 | Zitkus . | |
| 4,831,784 | 5/1989 | Takahashi | 51/131.1 |
| 4,979,334 | 12/1990 | Takahashi | 51/120 |
| 5,140,779 | 8/1992 | Grois | 51/217 R |
| 5,184,433 | 2/1993 | Maack . | |

FOREIGN PATENT DOCUMENTS

| | | | |
|---|---|---|---|
| 627280A1 | 12/1994 | European Pat. Off. . | |
| 57-127656 | 7/1982 | Japan | 24/7 |

OTHER PUBLICATIONS

Patent Abstracts of Japan, vol. 011, No. 032 (P–541) Jan. 30, 1987.

*Primary Examiner*—David A. Scherbel
*Assistant Examiner*—Dung Van Nguyen
*Attorney, Agent, or Firm*—Adams & Wilks

[57] ABSTRACT

A polishing apparatus comprises a holder having rod-shaped members each having an end portion to be polished. The rod-shaped members are positioned on the holder so that respective distances between the rod-shaped members and a center of the holder are different from one another. When relative motion is effected between the holder and the polishing member while maintaining distances between a center of the polishing member and the respective rod-shaped members different from one another and while pressing the respective end portions of the rod-shaped members against the polishing member, the respective end portions of the rod-shaped members are polished.

11 Claims, 5 Drawing Sheets

METHOD AND APPARATUS OF POLISHING END SURFACES OF ROD-SHAPED MEMBERS

BACKGROUND OF THE INVENTION

The present invention relates to a method of polishing end surfaces of rod-shaped members, which is suitable for polishing the respective end surfaces of a plurality of rod-shaped members at the same time.

For example, in the case where end surfaces of rod-shaped members such as ferrules with optical fibers are required to be finished into a desired shape by polishing the end surfaces, conventionally, as shown in FIG. 5, a large number of ferrules 102 with optical fibers are fixed to a periphery 101 of a regular polygonal holder 100 by suitable means while leaving a space between the ferrules, and a relative trochoid curvilinear motion is caused in the state that the respective tip ends of the ferrules 102 with optical fibers are pressed against a polishing disc 103 disposed opposite the holder 100, whereby the respective tip ends of the ferrules 102 with optical fibers are polished.

However, according to the conventional method as shown in FIG. 5, although end surfaces of a large number of rod-shaped members can be polished at the same time, as shown in FIG. 6, only a specific portion near an outer circumference (indicated by oblique lines) of the polishing disc 103 is used, so that a large part of a polishing sheet is not used, thus the conventional method has a problem that an economical use of the polishing sheet can not be attained.

An object of the present invention is therefore to provide a method of polishing end surfaces of rod-shaped members in which the entire surface of a polishing sheet is uniformly used so that a lifetime of the polishing sheet can be elongated and running costs can be lowered.

SUMMARY OF THE INVENTION

In order to achieve the above object, in a method of polishing end surfaces of rod-shaped members in which a plurality of rod-shaped members are mounted on a holder and a relative trochoid curvilinear motion is given between the holder and a polishing disc while the respective tip ends of the rod-shaped members are pressed against the polishing disc disposed opposite the holder so that the respective tip ends of the rod-shaped members are polished, the feature of the present invention is that the distances between the center of the polishing disc and the respective rod-shaped members are made different from one another. According to this method, it is avoided that the regions on the polishing disc used by the respective rod-shaped members become quite identical to one another, so that almost all the surface of the polishing disc can be used.

DETAILED DESCRIPTION OF THE PREFERRED EMBODIMENT

An embodiment of the present invention will now be described in detail with reference to the drawings.

Figure 1:
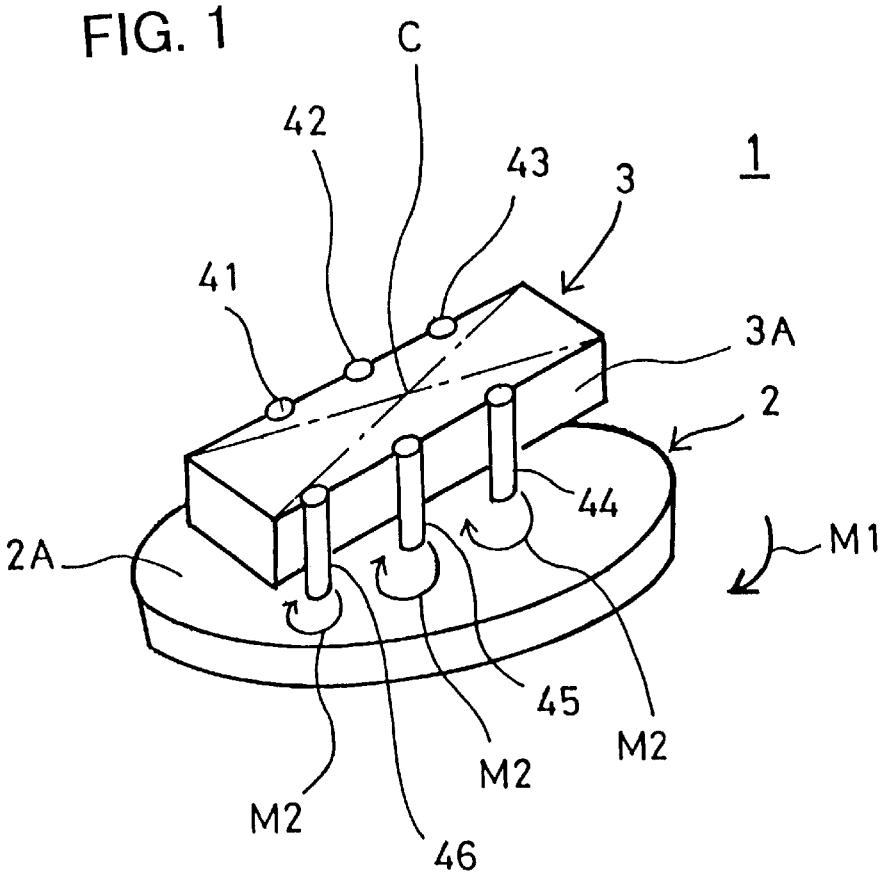
FIG. 1 is a schematic structural view showing an example of a polishing apparatus for practicing the method of the present invention.

FIG. 1 is a schematic structural view showing an embodiment of a polishing apparatus for practicing the method of the present invention. In this embodiment, a polishing apparatus 1 is constructed as an apparatus for polishing the respective tip ends of a plurality of ferrules with optical fibers into a spherical surface, and includes a circular polishing disc 2 and a holder (ferrule holder) 3 for supporting the ferrules with optical fibers.

Figure 2:
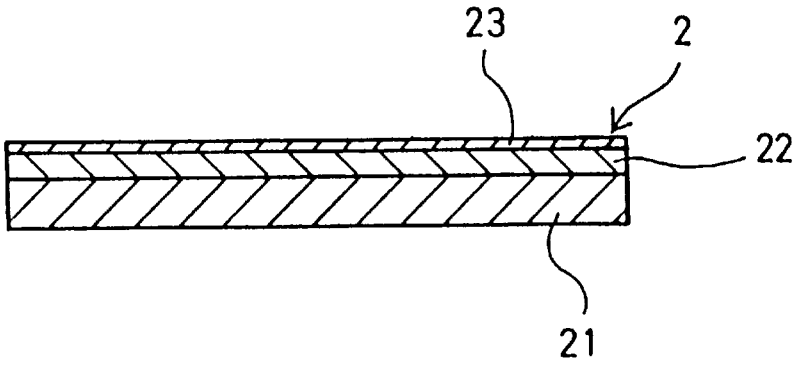
FIG. 2 is a sectional view showing a polishing disc shown in FIG. 1.

The polishing disc 2 has a well known structure, as shown in FIG. 2 in detail comprising a relatively thick elastic plate 22 having elasticity like rubber and disposed on a board 21 made of a stiff material, and a polishing sheet 23 bonded to the elastic plate 22. As the polishing surface, even if an abradant is applied to the board 21 instead of the elastic material, the same result can be obtained.

Returning to FIG. 1, the polishing disc 2 is attached to a driving apparatus (not shown). On the other hand, a holder 3 formed as a long and narrow rectangular parallelepiped is fixed to a frame of the not shown apparatus by a suitable means so that the holder is aligned to be parallel with the polishing sheet 23 with a predetermined space therebetween. The not shown driving apparatus is a motion causing apparatus of a well known structure capable of causing a trochoid curvilinear motion in a plane parallel with a main surface 2A of the polishing disc 2. As a result, the relative trochoid curvilinear motion can be given between the polishing disc 2 and the holder 3.

Figure 3:
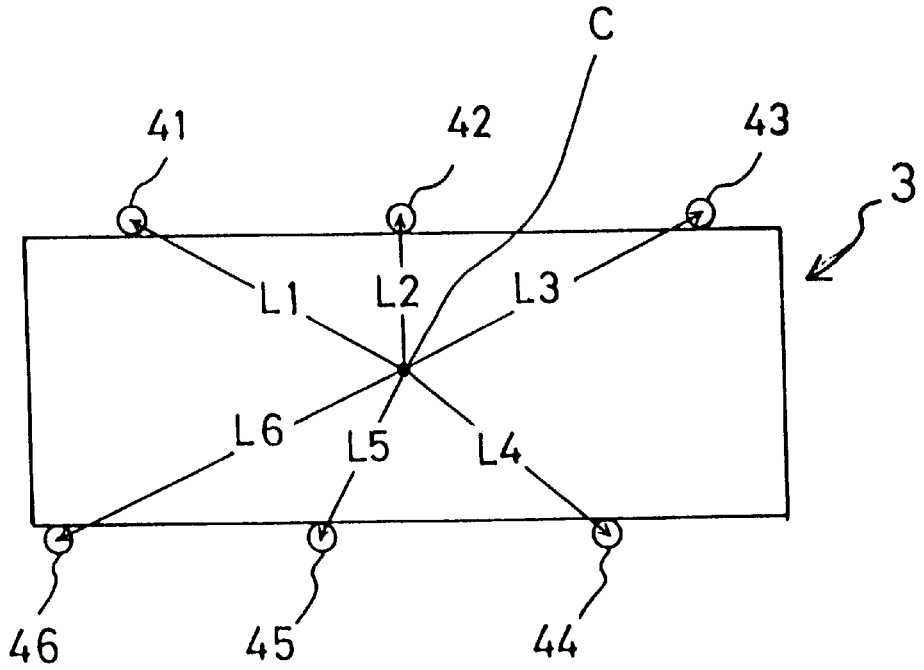
FIG. 3 is an explanatory view for explaining an example of a method of mounting ferrules with optical fibers on a holder shown in FIG. 1.

In order to finish the tip end portions of ferrules with optical fibers into a spherical surface by relative trochoid curvilinear motion, a plurality of ferrules 41 to 46 with optical fibers are mounted on a peripheral surface 3A of the holder 3 by well known means so that the ferrules have a predetermined posture to be almost vertical to the polishing disc 2. Here, in order to effectively use the polishing sheet 23, the ferrules 41 to 46 with optical fibers are positioned so that the respective distances L1, L2, . . . between the ferrules and the center point C of the holder 3 are made different from one another (see FIG. 3).

Figure 4:
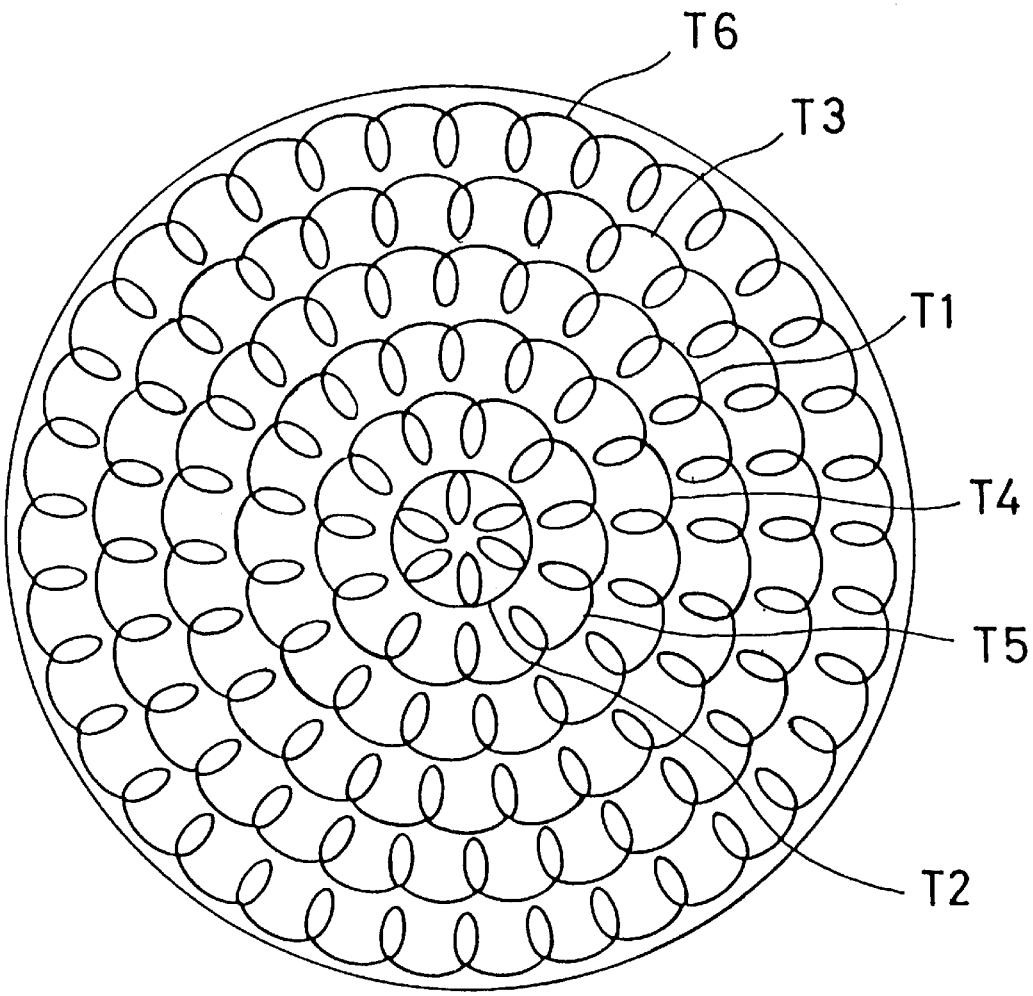
FIG. 4 is a view showing loci drawn by the tip ends of the ferrules with optical fibers on the polishing disc in the case of the mounting method shown in FIG. 3.
Figure 5:
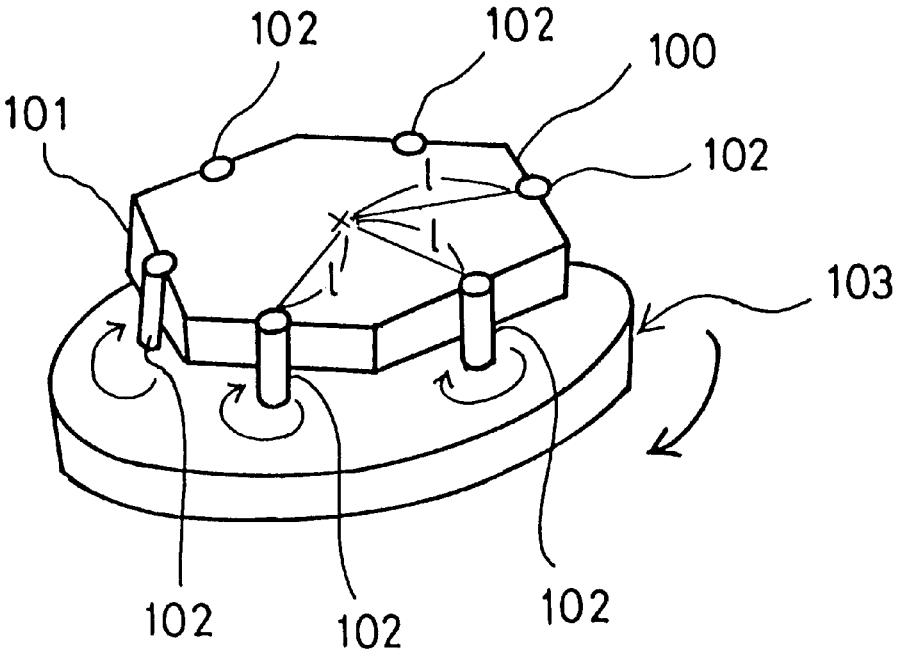
FIG. 5 PRIOR ART
FIG. 5 is a schematic structural view showing a conventional polishing apparatus.
Figure 6:
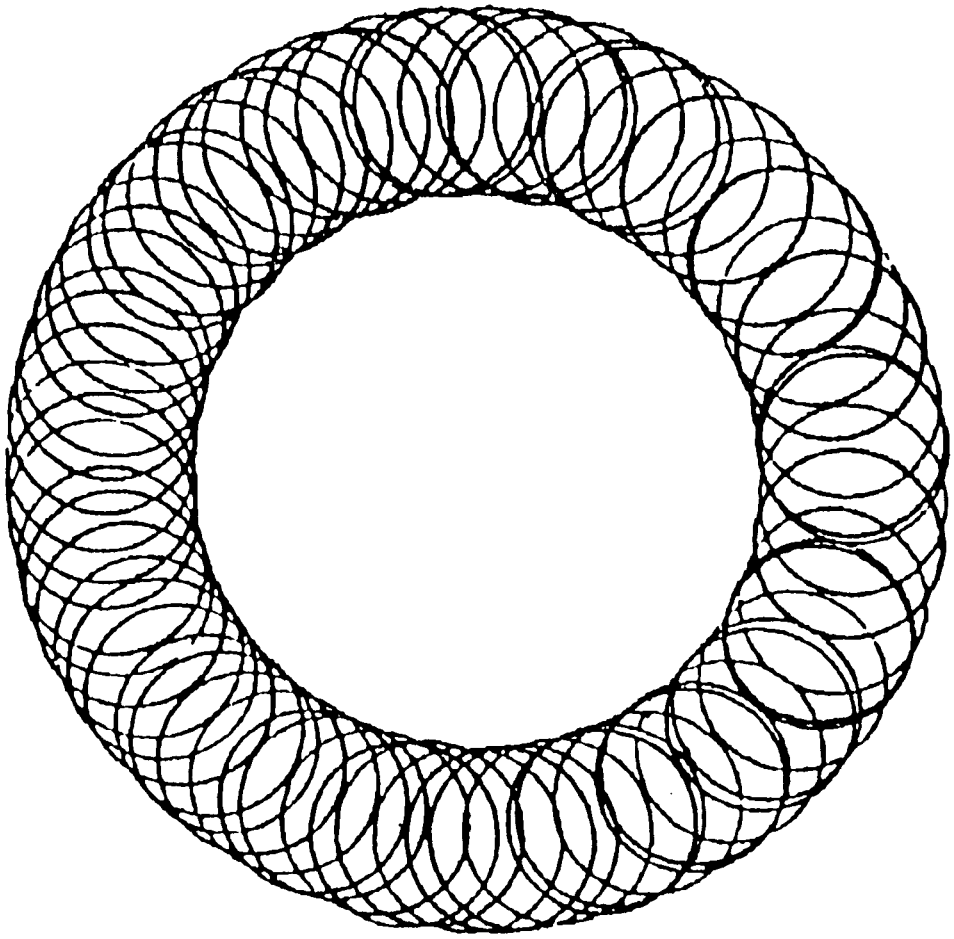
FIG . 6 PRIOR ART
FIG. 6 is a view for explaining the state of use of a polishing disc by the conventional polishing apparatus shown in FIG. 5.

Thus, if a relative trochoid curvilinear motion is given between the polishing disc 2 and the holder 3 in the state that the respective tip ends of the ferrules 41 to 46 with optical fibers are pressed against the polishing sheet 23, there is generated a combined motion of rotating motion M1 with a center axis of the polishing disc 2 as the center and small circular motions M2 of the respective tip ends of the ferrules 41 to 46 with optical fibers. As a result, as shown in FIG. 4, on the polishing sheet 23 of the polishing disc 2, loci T1 to T6 drawn by the respective tip ends of the ferrules 41 to 46 with optical fibers do not overlap with one another, so that almost all the surface of the polishing sheet 23 can be used and the polishing sheet 23 can be extremely effectively used. Accordingly, the lifetime of the polishing sheet 23 can be greatly elongated as compared with the prior art, and the running costs can be greatly lowered.

In the above described example, there is exemplified the case in which a rectangular parallelpiped mounting block having a rectangular plane shape is used as the holder. However, it is apparent front the above description that the holder may be formed into any shape as long as a plurality of ferrules with optical fibers can be mounted thereon so that the distances between the respective ferrules and the center of the polishing disc are different from one another. Accordingly, it is not necessarily required that the center of the holder should coincide with the center of the polishing disc. Further, in the example shown in FIG. 4, although the loci T1 to T6 do not overlap with one another, the method according to the present invention is not limited to this example, and the respective loci may partially overlap with one another as long as the distances between the respective rod-shaped members and the center of the polishing disc are different from one another.

According to the present invention, as described above, since the distances between the respective rod-shaped members and the center of a polishing disc are made different from one another, it is possible to avoid that only a specific portion of the polishing disc is concentrically used. As a result, it is possible to use almost all the surface of the polishing disc, so that the lifetime of the polishing disc can be elongated and the running costs can be decreased.

What is claimed is:

1. A method of polishing end surfaces of rod-shaped members comprising the steps of:

mounting a plurality of rod-shaped members on a holder to position the rod-shaped members so that respective distances between the rod-shaped members and a center of the holder are different from one another; and causing a relative trochoid curvilinear motion between the holder and a polishing disc disposed opposite the holder while maintaining distances between a center of the polishing disc and the respective rod-shaped members different from one another and while pressing respective tip ends of the rod-shaped members against the polishing disc so that the respective tip ends of the rod-shaped members are polished.

2. A method according to claim 1; wherein the pressing step includes pressing the respective tip ends of the rod-shaped members against a polishing surface of the polishing disc while maintaining the rod-shaped members generally perpendicular to the polishing surface of the polishing disc.

3. A method of polishing end surfaces of rod-shaped members comprising the steps of: providing a holder having a plurality of rod-shaped members positioned so that respective distances between the rod-shaped members and a center of the holder are different from one another; providing a polishing member having a polishing surface; and effecting relative motion between the holder and the polishing member while pressing respective tip ends of the rod-shaped members against the polishing surface of the polishing member to polish the respective tip ends of the rod-shaped members.

4. A method according to claim 3; wherein the effecting step comprises effecting a relative trochoid curvilinear motion between the holder and the polishing member.

5. A method according to claim 3; including the step of maintaining distances between a center of the polishing surface of the polishing member and the respective rod-shaped members different from one another during the effecting and pressing steps.

6. A method according to claim 3; wherein the pressing step includes pressing the respective ends of the rod-shaped members against the polishing surface of the polishing member while maintaining the rod-shaped members generally perpendicular to the polishing surface of the polishing member.

7. A method of polishing end surfaces of rod-shaped members comprising the steps of: providing a holder having a plurality of rod-shaped members mounted thereon so that respective distances between the rod-shaped members and a center of the holder are different from one another; providing a polishing member having a polishing surface; and effecting relative motion between the holder and the polishing member while maintaining distances between a center of the polishing member and the respective rod-shaped members different from one another and while pressing respective tip ends of the rod-shaped members against the polishing surface of the polishing member to polish the respective tip ends of the rod-shaped members.

8. A polishing apparatus comprising: a holder having a plurality of rod-shaped members each having an end portion to be polished, the rod-shaped members being positioned at different distances from a center of the holder; and a polishing member having a polishing surface for polishing the respective end portions of the rod-shaped members; whereby when relative motion is effected between the holder and the polishing member while pressing the respective end portions of the rod-shaped members against the polishing member, the respective end portions of the rod-shaped members are polished.

9. A polishing apparatus as claimed in claim 8; wherein the rod-shaped members are connected to peripheral surfaces of the holder.

10. A polishing apparatus as claimed in claim 8; wherein the polishing member is generally circular-shaped.

11. A polishing apparatus comprising: a holder having a plurality of rod-shaped members each having an end portion to be polished, the rod-shaped members being positioned at different distances from a center of the holder; and a polishing member having a polishing surface for polishing the respective end portions of the rod-shaped members; whereby when relative motion is effected between the holder and the polishing member while maintaining distances between a center of the polishing member and the respective rod-shaped members different from one another and while pressing the respective end portions of the rod-shaped members against the polishing disc, the respective end portions of the polishing members are polished.

* * * * *